US009593848B2

(12) United States Patent
Zink et al.

(10) Patent No.: US 9,593,848 B2
(45) Date of Patent: Mar. 14, 2017

(54) NON-SYMMETRICAL LOW $NO_x$ BURNER APPARATUS AND METHOD

(71) Applicant: ZEECO, INC., Broken Arrow, OK (US)

(72) Inventors: Darton J. Zink, Tulsa, OK (US); Rex K. Isaacs, Collinsville, OK (US); Parker Imel, Coweta, OK (US); Seth Marty, Broken Arrow, OK (US); Jonathon Barnes, Broken Arrow, OK (US); Cody Little, Coweta, OK (US); John McDonald, Broken Arrow, OK (US); Tim Kirk, Morris, OK (US); Tim Minihan, Broken Arrow, OK (US)

(73) Assignee: ZEECO, INC., Broken Arrow, OK (US)

( * ) Notice: Subject to any disclaimer, the term of this patent is extended or adjusted under 35 U.S.C. 154(b) by 394 days.

(21) Appl. No.: 14/299,820

(22) Filed: Jun. 9, 2014

(65) Prior Publication Data

US 2015/0354811 A1 Dec. 10, 2015

(51) Int. Cl.

| | |
|---|---|
| ***F23D 14/22*** | (2006.01) |
| ***F23D 14/62*** | (2006.01) |
| ***F23D 14/58*** | (2006.01) |
| ***F23D 14/60*** | (2006.01) |
| ***F23M 5/02*** | (2006.01) |
| ***F23C 6/04*** | (2006.01) |

(52) U.S. Cl.

CPC ..... *F23D 14/22* (2013.01); *F23C 6/045* (2013.01); *F23D 14/58* (2013.01); *F23D 14/60* (2013.01); *F23D 14/62* (2013.01); *F23M 5/025* (2013.01); *F23C 2201/20* (2013.01)

(58) Field of Classification Search

CPC ..... F23D 14/22; F23D 14/60; F23D 14/62; F23C 6/045; F23C 2201/20; F23M 5/025

See application file for complete search history.

(56) References Cited

U.S. PATENT DOCUMENTS

| | | | |
|---|---|---|---|
| 1,234,088 | A | 7/1917 | Ralston |
| 2,174,663 | A | 10/1939 | Keller |
| 2,643,916 | A | 6/1953 | White et al. |
| 2,671,507 | A | 3/1954 | Morck |
| 2,808,876 | A | 10/1957 | Loof |
| 2,851,093 | A | 9/1958 | Zink et al. |

(Continued)

FOREIGN PATENT DOCUMENTS

| | | | |
|---|---|---|---|
| EP | 0967440 | A2 | 12/1999 |
| JP | 2001030077 | A | 2/2001 |

(Continued)

OTHER PUBLICATIONS

Unknown, Advanced Rupture Disk Technology, Inc. "Gas Pilots", Apr. 20, 2010, Publisher: Internet Printout, Published in: US.

(Continued)

*Primary Examiner* — Alfred Basichas

(74) *Attorney, Agent, or Firm* — Dennis D. Brown; Brown Patent Law, P.L.L.C.

(57) ABSTRACT

A burner apparatus for a furnace system and a method of burner operation wherein a non-symmetrical positioning of one combustion fuel discharge tip or a grouping of fuel discharge tips within the burner wall produces side-by-side lean and fuel rich combustion stage zones and also produces internal flue gas recirculation.

20 Claims, 2 Drawing Sheets

(56) References Cited

U.S. PATENT DOCUMENTS

| | | | |
|---|---|---|---|
| 2,918,117 | A | 12/1959 | Griffin |
| 3,000,435 | A | 9/1961 | Bloom et al. |
| 3,033,273 | A | 5/1962 | Zink, Jr. et al. |
| 3,180,395 | A | 4/1965 | Reed |
| 3,198,436 | A | 8/1965 | Kurzinski et al. |
| 3,217,779 | A | 11/1965 | Reed et al. |
| 3,639,095 | A | 2/1972 | Zink et al. |
| 3,644,076 | A | 2/1972 | Bagge |
| 3,672,655 | A | 6/1972 | Carter |
| 3,737,105 | A | 6/1973 | Arnold et al. |
| 3,771,944 | A | 11/1973 | Hovis et al. |
| 3,798,948 | A | 3/1974 | Fangmeier et al. |
| 3,876,362 | A | 4/1975 | Hirose |
| 3,915,621 | A | 10/1975 | Iverson |
| 3,924,574 | A | 12/1975 | Ebeling |
| 3,929,511 | A | 12/1975 | Solomon |
| 3,947,216 | A | 3/1976 | Teodorescu et al. |
| 3,954,382 | A | 5/1976 | Hirose |
| 4,004,875 | A | 1/1977 | Zink et al. |
| 4,009,989 | A | 3/1977 | Bitterlich |
| 4,014,654 | A | 3/1977 | Howell |
| 4,162,140 | A | 7/1979 | Reed |
| 4,181,491 | A | 1/1980 | Hovis |
| 4,231,735 | A | 11/1980 | Downs |
| 4,237,858 | A | 12/1980 | Goodnight et al. |
| 4,257,762 | A | 3/1981 | Zink et al. |
| 4,257,763 | A | 3/1981 | Reed |
| 4,277,942 | A | 7/1981 | Egnell et al. |
| 4,289,474 | A | 9/1981 | Honda et al. |
| 4,395,223 | A | 7/1983 | Okigami et al. |
| 4,412,808 | A | 11/1983 | Sheppard et al. |
| 4,428,727 | A | 1/1984 | Deussner et al. |
| 4,451,230 | A | 5/1984 | Bocci et al. |
| 4,476,791 | A | 10/1984 | Cegielski, Jr. |
| 4,483,832 | A | 11/1984 | Schirmer |
| 4,496,306 | A | 1/1985 | Okigami et al. |
| 4,505,666 | A | 3/1985 | Martin et al. |
| 4,575,332 | A | 3/1986 | Oppenberg et al. |
| 4,702,691 | A | 10/1987 | Ogden |
| 4,708,638 | A | 11/1987 | Brazier et al. |
| 4,756,684 | A | 7/1988 | Nishikawa et al. |
| 4,945,841 | A | 8/1990 | Nakamachi et al. |
| 5,044,932 | A | 9/1991 | Martin et al. |
| 5,073,105 | A | 12/1991 | Martin et al. |
| 5,098,282 | A | 3/1992 | Schwartz et al. |
| 5,118,284 | A | 6/1992 | Mutchler |
| 5,138,860 | A | 8/1992 | Del Fabro et al. |
| 5,154,596 | A | 10/1992 | Schwartz et al. |
| 5,180,300 | A | 1/1993 | Hovis et al. |
| 5,195,884 | A | 3/1993 | Schwartz et al. |
| 5,238,395 | A | 8/1993 | Schwartz et al. |
| 5,269,678 | A | 12/1993 | Schwartz et al. |
| 5,271,729 | A | 12/1993 | Gensler et al. |
| 5,284,438 | A | 2/1994 | McGill et al. |
| 5,302,113 | A | 4/1994 | Eichelberger et al. |
| 5,344,307 | A | 9/1994 | Schwartz et al. |
| 5,441,404 | A | 8/1995 | Christenson |
| 5,458,481 | A | 10/1995 | Surbey et al. |
| 5,542,840 | A | 8/1996 | Surbey et al. |
| 5,545,031 | A | 8/1996 | Joshi et al. |
| 5,554,022 | A | 9/1996 | Nabors, Jr. et al. |
| 5,575,637 | A | 11/1996 | Slavejkov et al. |
| 5,611,682 | A | 3/1997 | Slavejkov et al. |
| 5,632,614 | A | 5/1997 | Consadori et al. |
| 5,676,010 | A | 10/1997 | College et al. |
| 5,680,823 | A | 10/1997 | LaRose |
| 5,688,115 | A | 11/1997 | Johnson |
| 5,709,541 | A | 1/1998 | Gensler et al. |
| 5,816,466 | A | 10/1998 | Seufer |
| 5,957,678 | A | 9/1999 | Endoh et al. |
| 5,975,886 | A | 11/1999 | Philippe |
| 5,980,243 | A | 11/1999 | Surbey et al. |
| 6,007,325 | A | 12/1999 | Loftus et al. |
| 6,045,353 | A | 4/2000 | VonDrasek et al. |
| 6,067,835 | A | 5/2000 | Pollock |
| 6,176,087 | B1 | 1/2001 | Snyder et al. |
| 6,471,508 | B1 | 10/2002 | Finke et al. |
| 6,499,990 | B1 | 12/2002 | Zink |
| 6,536,950 | B1 | 3/2003 | Green et al. |
| 6,626,661 | B1 | 9/2003 | Zink |
| 6,672,858 | B1 | 1/2004 | Benson et al. |
| 6,695,609 | B1 | 2/2004 | Chung et al. |
| 6,875,008 | B1 | 4/2005 | Martin et al. |
| 7,383,973 | B2 | 6/2008 | Enyedy |
| 7,441,682 | B2 | 10/2008 | Kerekes et al. |
| 7,531,015 | B2 | 5/2009 | Wolf et al. |
| 7,670,135 | B1 | 3/2010 | Zink |
| 7,777,977 | B2 | 8/2010 | Chase et al. |
| 7,907,272 | B2 | 3/2011 | Zelepouga et al. |
| 8,138,927 | B2 | 3/2012 | Diepenbroek et al. |
| 8,274,560 | B2 | 9/2012 | Galfrascoli et al. |
| 2001/0018171 | A1 | 8/2001 | Al-Halbouni |
| 2001/0034001 | A1 | 10/2001 | Poe et al. |
| 2003/0148236 | A1 | 8/2003 | Joshi et al. |
| 2004/0018461 | A1 | 1/2004 | Stephens et al. |
| 2004/0050131 | A1 | 3/2004 | Militaru et al. |
| 2005/0239005 | A1 | 10/2005 | Lugnet et al. |
| 2005/0266363 | A1 | 12/2005 | Ganeshan |
| 2007/0266634 | A1 | 11/2007 | Tsangaris et al. |
| 2007/0289216 | A1 | 12/2007 | Tsangaris et al. |
| 2007/0292811 | A1 | 12/2007 | Poe et al. |
| 2008/0199554 | A1 | 8/2008 | Manda et al. |
| 2008/0233523 | A1 | 9/2008 | Diepenbroek et al. |
| 2013/0122440 | A1 | 5/2013 | Zink et al. |

FOREIGN PATENT DOCUMENTS

| | | |
|---|---|---|
| JP | 2001205335 | 7/2001 |
| JP | 2003266149 A | 9/2003 |
| JP | 2008110359 A | 5/2008 |
| WO | WO 9004740 | 5/1990 |
| WO | WO 9850191 | 11/1998 |
| WO | 2015042237 | 3/2015 |

OTHER PUBLICATIONS

John zink.com, "Pilot Monitoring Systems", Apr. 20, 2010, Publisher: Internet Printout, Published in: US.

John zink.com, "Retractable Systems", Apr. 20, 2010, Publisher: Internet Printout, Published in: US.

John zink.com, "Retractable Thermocouples", Apr. 20, 2010, Publisher: Internet Printout, Published in: US.

Zeeco, Inc., "Auxiliary Equipment Pilot Monitors", Apr. 20, 2010, Publisher: Internet Printout, Published in: US.

Vandermeer, Willy; "Flame Safeguard Controls in Multi-Burner Environments"; Apr. 1998; Published in: US.

Borg, Stephen et al; "A Fiber-Optic Probe Design for Combustion Chamber Flame Detection Applications"; NASA/TM-2001-211233; Oct. 2001; Published in: US.

U.S. Appl. No. 14/197,333; ":Fuel-Flexible Burner Apparatus and Method for Fired Heaters"; First Named Inventor: Darton J. Zink; filed Mar. 5, 2014.

U.S. Appl. No. 13/789,004; "Apparatus and Method for Monitoring Flares and Flare Pilots"; First Named Inventor: Cody L Little; filed Mar. 7, 2013.

U.S. Appl. No. 13/935,152; "Apparatus for Installing a Retractable Thermocouple"; First Named Inventor: Clayton A. Francis; filed Jul. 3, 2013.

PCT/US2015/029048 International Search Report and Written Opinion; Jul. 23, 2015.

NON-SYMMETRICAL LOW $NO_x$ BURNER APPARATUS AND METHOD

FIELD OF THE INVENTION

The present invention relates to burner assemblies and to methods and apparatuses for reducing $NO_x$ emissions from burners of the type used in process heaters, boilers, furnaces and other fired heating systems.

BACKGROUND OF THE INVENTION

Many industrial applications require large scale generation of heat from burners for process heaters, boilers, furnaces, or other fired heating systems. If the burner fuel is thoroughly mixed with air and combustion occurs under ideal conditions, the resulting combustion products are primarily carbon dioxide and water vapor. However, when the fuel is burned under less than ideal conditions, e.g., at a high flame temperature, nitrogen present in the combustion air reacts with oxygen to produce nitrogen oxides ($NO_x$). Other conditions being equal, $NO_x$ production increases as the temperature of the combustion process increases. $NO_x$ emissions are generally considered to contribute to ozone depletion, acid rain, smog, and other environmental problems.

For gaseous fuels with no fuel bound nitrogen, thermal $NO_x$ is the primary mechanism of $NO_x$ production. Thermal $NO_x$ is produced when the flame reaches a high enough temperature to break the covalent $N_2$ bond so that the resulting "free" nitrogen atoms then bond with oxygen to form $NO_x$.

Typically, the temperature of combustion is not great enough to break all of the $N_2$ bonds. Rather, most of the nitrogen in the air stream passes through the combustion process and remains as diatomic nitrogen ($N_2$) in the combustion products. However, some of the $N_2$ will typically reach a high enough temperature in the high intensity regions of the flame to break the $N_2$ bond and form "free" nitrogen. Once the covalent nitrogen bond is broken, the "free" nitrogen is available to bond with other atoms. Fortunately, the free nitrogen will most likely react with other free nitrogen atoms to form $N_2$. However, if another free nitrogen atom is not available, the free nitrogen will react with oxygen to form $NO_x$.

As the temperature of the burner flame increases, the stability of the $N_2$ covalent bond decreases, causing increasing production of free nitrogen and thus also increasing the production of thermal $NO_x$ emissions. Consequently, in an ongoing effort to reduce $NO_x$ emissions, various types of burner designs and theories have been developed with the objective of reducing the peak flame temperature.

The varied requirements of refining and petrochemical processes require the use of numerous different types and configurations of burners. The approaches used to lower $NO_x$ emissions can differ from application to application. However, thermal $NO_x$ reduction is generally achieved by slowing the rate of combustion. Since the combustion process is a reaction between oxygen and the burner fuel, the objective of delayed combustion is typically to reduce the rate at which the fuel and oxygen mix together and burn. The faster the oxygen and the fuel gas mix together, the faster the rate of combustion and the higher the peak flame temperature.

Examples of different types of burner design approaches used for reducing $NO_x$ emissions have included:

a. Staged air designs wherein the combustion air is typically separated into two or more flows to create separate zones of lean and rich combustion.
b. Designs using Internal Flue Gas Recirculation (IFGR) wherein some of the burner fuel gas passes through and mixes with the inert products of combustion (flue gas) in the combustion system to form a diluted fuel gas which burns at a lower peak flame temperature.
c. Staged fuel designs wherein fuel gas is separated into two or more flows to create separate zones of lean and rich combustion.
d. Designs using External Flue Gas Recirculation (EFGR) wherein inert products of combustion are mixed with the combustion air to reduce the oxygen concentration of the air stream supplied to the burner, which in turn lowers the peak flame temperature.
e. Designs using "flameless" combustion wherein most or all of the burner fuel gas passes through and mixes with inert products of combustion to form a diluted fuel gas which burns at a lower peak flame temperature. The mixture of fuel gas and inert products of combustion can be as high as 90% inert, thus resulting in a "transparent" flame.
f. Designs using steam and/or inert injection into the burner fuel gas wherein the steam or inert components mix with the fuel gas so that the resulting composition will burn at a lower peak flame temperature.
g. Designs using steam and/or inert injection into the combustion air stream wherein the steam and/or inert components mix with the combustion air so that the resulting composition will burn at a lower peak flame temperature.

SUMMARY OF THE INVENTION

The present invention provides a low NO burner apparatus and method which satisfy the needs and alleviate the problems discussed above. Unlike many prior art burners which are only capable of providing either staged air operation or internal flue gas recirculation (IFGR) for lowering combustion temperatures and reducing $NO_x$ emissions, the inventive burner and method provide both staged air operation and IFGR. Moreover, the inventive burner and method are capable of providing both staged air operation and IFGR using, if desired, only a single combustion fuel riser and discharge tip. Therefore, in addition to being more effective for reducing NO emissions, the inventive burner and method are less complicated and less costly than many prior art "low $NO_x$" burner systems. Further, the inventive burner and method also provide high level performance in regard to flame length, available turndown ratio, and stability.

In one aspect, there is provided a burner apparatus for a fired heating system. The burner apparatus preferably includes a burner wall having a forward end wherein (a) the burner wall surrounds an air flow passageway which extends through the burner wall, (b) the air flow passageway has a forward discharge opening at the forward end of the burner wall, and (c) the burner wall has a longitudinal axis which extends through the air flow passageway. In addition, the burner apparatus preferably includes within the air flow passageway only one combustion fuel discharge tip assembly. The combustion fuel discharge tip assembly within the air flow passageway preferably comprises (1) a single combustion fuel discharge tip having a forward end and (2) a flame stabilizing structure located at, forwardly of, or rearwardly of the forward end of the combustion fuel discharge tip. The combustion fuel discharge tip is preferably located laterally outward with respect to the longitudinal axis of the burner wall at a position which is between the longitudinal axis and the burner wall.

In another aspect, the inventive burner apparatus preferably also comprises: (a) a fuel rich combustion zone projecting forwardly from the forward discharge opening of the air flow passageway wherein combustion occurs in an excess fuel to oxygen ratio, the fuel rich combustion zone being located adjacent to a first interior side of a burner wall and (b) a lean combustion zone projecting forwardly from the forward discharge opening of the air flow passageway wherein combustion occurs in an excess oxygen to fuel ratio, the lean combustion zone being located adjacent to a second interior side of the burner wall opposite the first interior side of the burner wall.

In addition, this burner apparatus also preferably comprises a flue gas recirculation region projecting forwardly from the forward discharge opening of the air flow passageway wherein combustion occurs with recirculated inert products of combustion being present, the flue gas recirculation region being located adjacent to the first interior side of the burner wall.

As used herein, and in the claims, the term "fired heating system" refers to and includes boilers, process heaters, furnaces and any other type of fired heating system. Also, the term "combustion fuel discharge tip" as used herein and in the claims refers to and includes any type of ejector, nozzle, or other burner fuel discharge tip structure used in burner apparatuses for fired heating systems.

In another aspect, there is provided a method of operating a burner wherein the method preferably comprises the steps of: (a) delivering an oxygen-containing gas (e.g., air) through a flow passageway surrounded by a burner wall, the flow passageway having a forward discharge opening at a forward end of the burner wall, the burner wall having a longitudinal axis which extends through the flow passageway, the forward discharge opening having a first lateral half between the longitudinal axis and a first interior side of the burner wall, and the forward discharge opening having a second lateral half between the longitudinal axis and a second interior side of the burner wall opposite the first interior side of the burner wall and (b) forwardly discharging non-pilot combustion fuel from at least a portion of the first lateral half, but not from the second lateral half, of the forward discharge opening of the flow passageway. The discharging of non-pilot combustion fuel from the first lateral half but not the second lateral half of the forward discharge opening creates (i) a lean combustion zone projecting forwardly from the forward discharge opening of the flow passageway wherein combustion occurs in an excess oxygen to fuel ratio, the lean combustion zone being located adjacent to the second interior side of the burner wall and (ii) a fuel rich combustion zone projecting forwardly from the forward discharge opening of the flow passageway wherein combustion occurs in an excess fuel to oxygen ratio, the fuel rich combustion zone being located adjacent to the first interior side of the burner wall.

In another aspect, at least a portion of the fuel rich combustion zone closest to the first interior side of said burner wall in this inventive method is preferably a forwardly projecting flue gas recirculation region wherein inert products of combustion recirculate back into the fuel rich combustion zone.

Further aspects, features, and advantages of the present invention will be apparent to those of ordinary skill in the art upon examining the accompanying drawings and upon reading the following Detailed Description of the Preferred Embodiments.

DETAILED DESCRIPTION OF THE PREFERRED EMBODIMENTS

Figure 1:
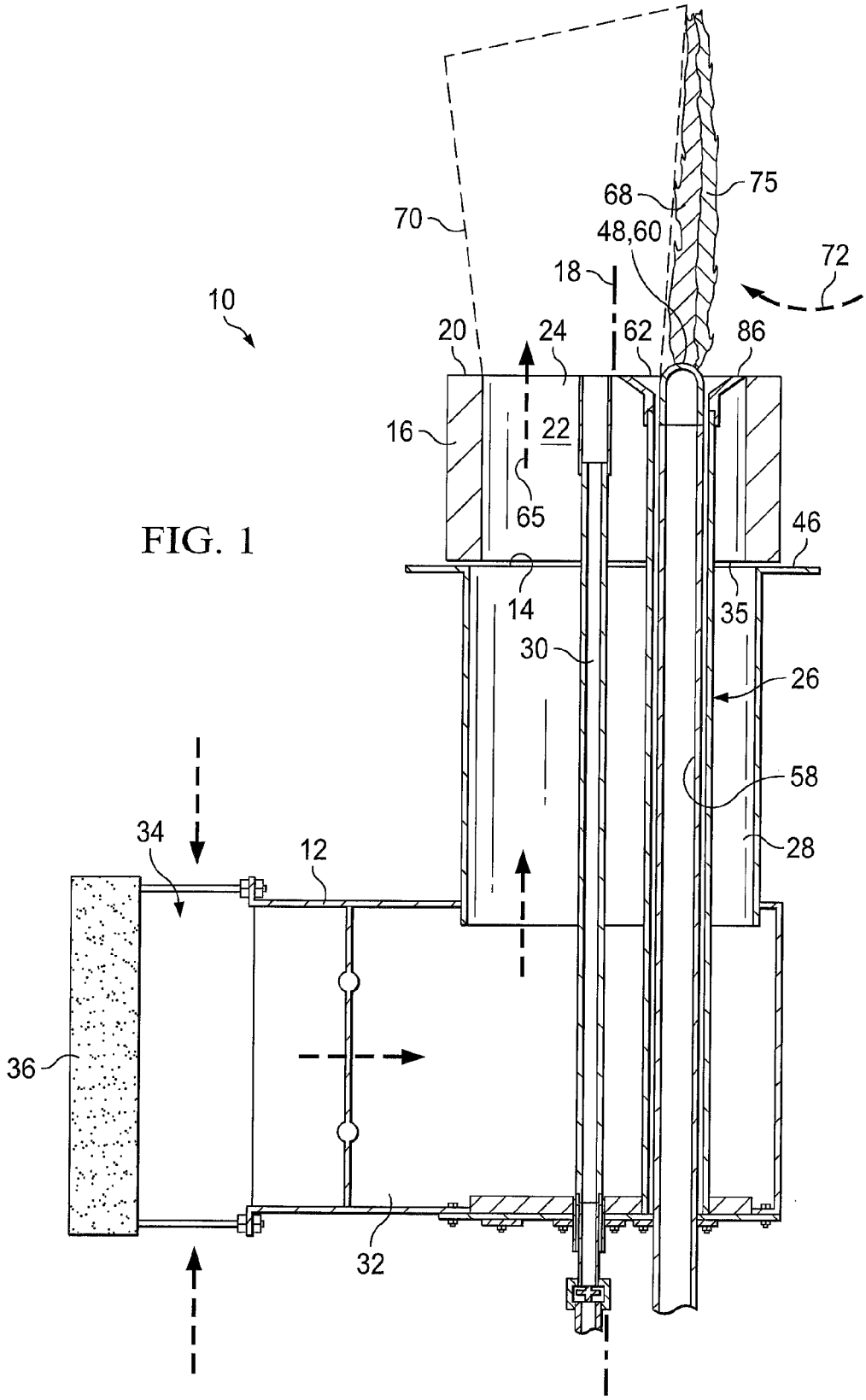
FIG. 1 is a partially cutaway elevational side view of an embodiment 10 of the inventive non-symmetrical burner apparatus.
Figure 2:
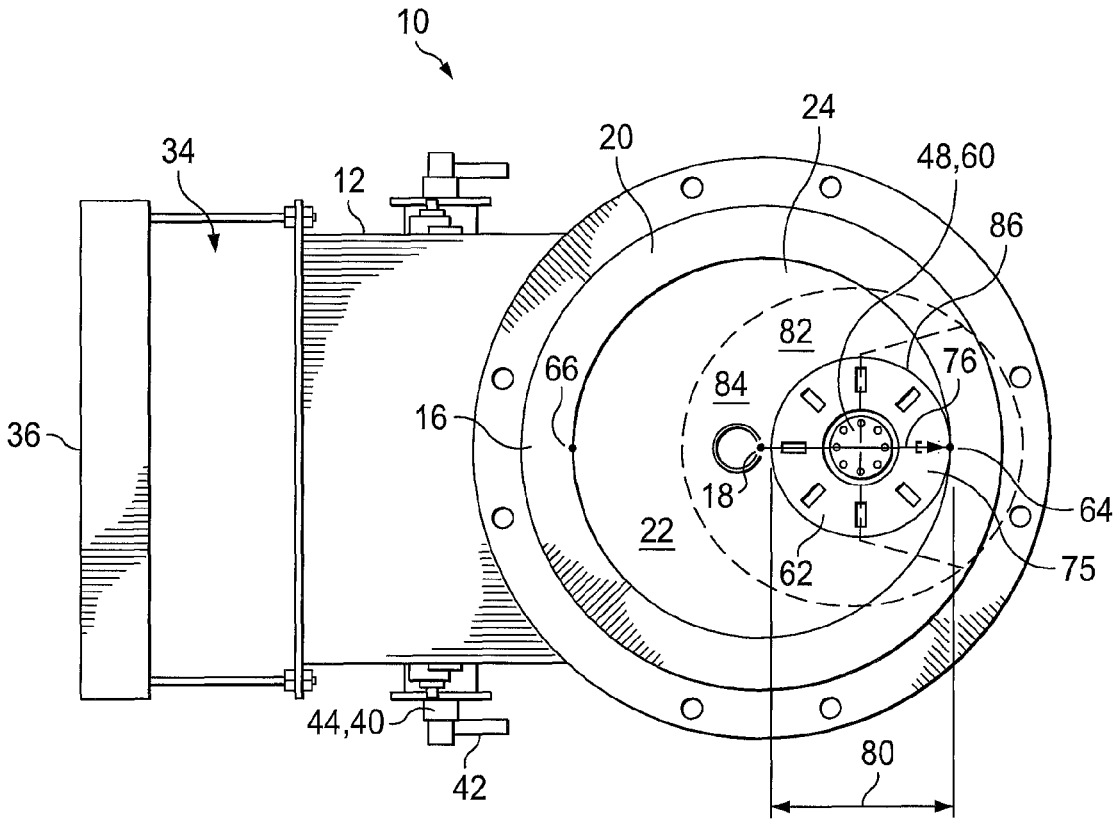
FIG. 2 is a discharge end view of the inventive non-symmetrical burner apparatus 10.

An embodiment 10 of the inventive burner apparatus is illustrated in FIGS. 1 and 2. The inventive burner 10 is a non-symmetrical burner apparatus which preferably comprises: a housing 12 having an outlet end 14; a burner wall 16 which is positioned at the outlet end 14 of the housing 12 and has a longitudinal axis 18 which extends therethrough; an air flow passageway 22 which extends through and is surrounded by the burner wall 16 and has a forward discharge opening 24 at the forward end 20 of the burner wall 16; a single combustion fuel discharge tip assembly 26 which extends through a discharge section 28 of the housing 12 and into the air flow passageway 22 of the burner wall 16; and a pilot burner assembly 30 which also extends through the discharge section 28 of the housing 12 and into the air flow passageway 22 of the burner wall 16.

The housing 12 comprises: an inlet section 32 upstream of the discharge section 28 for receiving combustion air or other oxygen containing gas via an inlet opening 34; a muffler 36 provided at the inlet opening 34; and an adjustable damper 40 which is provided in the inlet section 32 and includes an exterior adjustment handle 42.

Combustion air (or an alternative oxygen-containing gas) is received through the inlet opening 34 of the housing 12 and flows through the housing 12 to the inlet end 35 of the burner wall 16. The air (or other oxygen-containing gas) then flows through the flow passageway 22 of the burner wall 16 and exits the forward discharge opening 24 of the passageway 22. The quantity of combustion air entering housing 12 can be regulated using the inlet damper 40. The damper is preferably mounted using a bearing assembly 44 for smooth, precise operation. Combustion air can be provided to housing 12 by forced circulation, natural draft, a combination thereof, or in any other manner employed in the art. In the case of forced air circulation, the muffler 36 will preferably be removed to allow a forced air connection.

The burner wall 16 is preferably constructed of a high temperature refractory burner tile material. However, it will be understood that the burner wall 16 could alternatively be formed of or provided by the furnace floor, a metal band, a refractory band, or any other material or structure which is capable of (a) providing an acceptable combustion air flow orifice (i.e., passageway) into the fired heating system and (b) withstanding high temperature operating conditions.

The forward (discharge) end 20 of burner wall 16 is in communication with the interior of the boiler, fired heater, furnace or other fired heating system enclosure in which combustion takes place. As a result of the combustion process which takes place in the enclosure of the fired heating system, the enclosure will also contain combustion product gases (i.e., flue gas) 72. The inventive burner 10 can be installed, for example, through a floor or wall 46 of the fired heating system enclosure, which will typically be formed of metal. An insulating material will also typically be secured to the interior surface of the floor or wall 46 outside of the burner wall 16.

The burner wall 16 and the air flow passageway 22 extending therethrough will preferably have round (circular) cross-sectional shapes. However, it will be understood that the cross-sectional shapes of the burner wall 16 and the air flow passageway 22 can alternatively be square, rectangular, oval, or generally any other shape desired.

The pilot burner assembly 30 will preferably be located within the combustion air passageway 22 of the burner wall 16 for initiating combustion at the outer (forward) end 48 of the combustion fuel discharge tip assembly 26. As will be understood by those skilled in the art, the inventive burner apparatus 10 can also include one or more auxiliary pilots or, rather than using one or more pilot burners, combustion in the apparatus 2 can be initiated using, for example, a temporary ignition device suitable for achieving reliable ignition.

The combustion fuel discharge tip assembly 26 preferably comprises: a combustion fuel riser or other conduit 58 which extends through the discharge section 28 of the housing 12 and into the air flow passageway 22 of the burner wall 22; a combustion fuel discharge tip 60 on the outer (forward) end of the fuel riser 58; and a flame stabilizing structure 62 which is preferably positioned at or proximate to the outer (forward) end 48 of the combustion fuel discharge tip 60. More preferably, the forward most edge, surface, or other forward most portion 86 of the flame stabilizing structure 62 will be positioned within a range of from 50 mm forwardly to 50 mm rearwardly of the outer (forward) end 48 of the combustion fuel discharge tip 60 and will most preferably be positioned within a range of from 25 mm forwardly to 25 mm rearwardly of the outer end 48.

As used herein and in the claims, the terms "combustion fuel discharge tip assembly" and "combustion fuel discharge tip" refer to the fuel delivery and discharge assemblies and structures used in the burner for delivering and discharging the fuel which is combusted by the burner for process heat transfer in the fired heating system. Consequently, the terms "combustion fuel discharge tip assembly" and "combustion fuel discharge tip" do not refer to and do not include pilot burner assemblies and tips, such as, for example, the pilot burner assembly 30 used in the inventive burner apparatus 10. In other words, as used herein, combustion fuel discharge tip assemblies and combustion fuel discharge tips refer to assemblies and structures for delivering non-pilot combustion fuel.

The inventive burner apparatus 10 as shown in FIGS. 1 and 2 is referred to herein as a "non-symmetrical" burner because the single combustion fuel discharge tip 60 used in the burner apparatus 10 is not centrally located within the burner wall 16 in alignment with the longitudinal axis 18. Rather, the discharge tip 60 is positioned laterally outward within the air flow passageway 22 with respect to the longitudinal axis 18 such that the discharge tip 60 is positioned closer to one interior side 64 of the burner wall 16 than it is the interior side 66 of the burner wall 16 which is directly opposite the interior side 64.

This inventive non-symmetrical positioning of the single combustion fuel discharge tip 60 in the air flow passage 22 produces a staged air operation in the inventive burner 10 wherein the ejection of the combustion fuel from the combustion fuel discharge tip 60 simultaneously creates (a) a forwardly projecting fuel rich combustion zone 68 which is adjacent to the lateral interior side 64 of the burner wall 16 and (b) a forwardly projecting lean combustion zone 70 which is adjacent to the lateral interior side 66 of said burner wall 16 opposite the lateral interior side 64. In other words, the fuel rich combustion zone 68 and the lean combustion zone 70 project forwardly from opposite lateral sides of the forward discharge opening 24 of the burner wall 10.

In the fuel rich combustion zone or stage 68 of the inventive burner 10, combustion occurs in an excess fuel to air ratio. In the lean combustion zone or stage 70, on the other hand, combustion occurs in an excess air to fuel ratio.

By way of further explanation, since the fuel discharge tip 60 and the flame stabilizer 62 are located next to or closer to one side (i.e., the lateral interior side 64) of the burner wall 16, a first portion of the fuel ejected from the fuel discharge tip 60 is caused to flow adjacent to the combustion air stream 65 traveling through the air flow passage 22 while a second portion of the ejected fuel is caused to flow adjacent to the products of combustion 72 outside of the burner wall 16. Consequently, a much larger proportion of the total combustion air stream 65 mixes with the first portion of the ejected fuel, thus forming the lean combustion zone or stage 70. Since more combustion air than fuel gas is present in the lean combustion zone 70, the peak flame temperature in the lean combustion zone 70 is reduced, resulting in lower thermal NO emissions.

The second portion of the fuel, on the other hand, is burned in the fuel rich zone or stage 68 where much less combustion air is available. In addition, because the portion of the fuel combusted in the fuel rich combustion zone 68 is ejected adjacent to, and therefore mixes with, the inert products of combustion 72 outside of the burner wall 16, the inert products of combustion also condition this portion of the fuel to thereby further lower the flame temperature in the fuel rich zone 68 and produce lower thermal NO emissions. This Internal Flue Gas Recirculation (IFGR) in the fuel rich combustion zone 68 is also enhanced significantly by the forward discharge momentum of the combustion air stream 65 which assists in pulling the exterior inert products of combustion 72 into the ejected fuel.

In the inventive non-symmetrical burner 10, IFGR can be produced in the entire fuel rich combustion zone 68 or can occur in a smaller or different flue gas recirculation region 75 which projects forwardly from the forward discharge opening 24 of the air flow passageway 22. In other words, the flue gas recirculation region 75 can be either (a) the entire fuel rich combustion zone 68, (b) an outer portion of the fuel rich combustion zone 68 or (c) a separate region which is adjacent to the fuel rich combustion zone 68.

Although the inventive burner apparatus 10 illustrated in FIGS. 1 and 2 includes only a single combustion fuel discharge tip assembly 26 and a single combustion fuel discharge tip 60, it will be understood that alternative embodiments of the inventive non-symmetrical burner which have side-by-side fuel rich and lean combustion zones and which also provide IFGR in or adjacent to the fuel rich zone can be produced using two or more discharge tip assemblies and discharge tips.

By way of example, in accordance with the method of the present invention, an inventive non-symmetrical burner can be provided and operated by discharging, either from a single discharge tip or from a collection of two or more discharge tips, significantly more fuel (preferably all or substantially all of the fuel) from one lateral half 82 (or more preferably a smaller portion of the lateral half 82) of the forward opening 24 of the burner wall 16 versus the opposing other half 84 of the forward opening 24, thereby creating side-by-side lean and fuel rich combustion zones. When using multiple fuel discharge tips and assemblies, such a flow pattern can produced, for example, by grouping the multiple discharge tip assemblies and discharge tips within the burner wall 16 at locations which are closer to one lateral interior side 64 of the burner wall 16 than to the opposite lateral interior side 66 of the burner wall 16.

The use of multiple fuel discharge tips will also allow multiple gas or liquid fuels to be burned simultaneously in the same burner. In this scenario, each fuel stream can, for example, be dedicated to a single tip located against or proximate to one burner wall to allow the inventive $NO_x$ reduction method to be utilized for each fuel stream individually.

In the inventive burner 10, the fuel discharge tip 60 is located laterally outward with respect to the longitudinal axis 18 of the burner wall 16 at a position which is between the longitudinal axis 18 and the interior side 64 of the burner wall 16. The fuel discharge tip 60 (or the grouping of discharge tips if more than one tip is used) will preferably be located laterally outward with respect to the longitudinal axis 18 at a position which is at least one quarter (more preferably at least one third) of the radial distance 76 from the longitudinal axis 18 to the lateral interior side 64 burner wall 16. Still more preferably, the fuel discharge tip 60 will be located laterally outward with respect to the longitudinal axis 18 of the burner wall 16 at a position which is at least 40% of the radial distance 76 from the longitudinal axis 18 to the lateral interior side 64 burner wall 16.

The fuel discharge tip 60 of the inventive burner 10 can be a gas fuel ejection tip or a liquid fuel ejection tip, but will preferably be a gas ejection tip. The fuel gas used in the inventive burner and method can be natural gas, refinery gas, or generally any other type of gas fuel or gas fuel blend employed in process heaters, boilers, or other gas-fired heating systems. Examples of types of fuel ejection tips preferred for use in the inventive burner 10 include, but are not limited to, round flame tips and flat flame tips. The fuel discharge tip 60 used in the inventive burner 10 will preferably be a round flame tip.

The forward end 48 of the fuel discharge tip 60 will preferably be located at or proximate to the forward discharge opening 24 of the air flow passageway 22. The forward end 48 of the fuel ejection tip 60 will preferably be located within a range of from not more than 50 mm rearwardly to not more than 50 mm forwardly of the discharge opening 24 and will more preferably be located within a range of from 25 mm rearwardly to 25 mm forwardly of the discharge opening 24.

Examples of types of flame stabilizing structures suitable for use used in the discharge tip assembly 26 of the inventive burner 10 include, but are not limited to, stabilization cones, swirlers, air diffusers, spin vanes, regeneration tiles, or any bluff body, including an extension of the burner tile, for providing a region of mixing and stable flame.

The flame stabilizing structure 62 used in the inventive burner 10 will preferably be a stabilization cone as illustrated in FIGS. 1 and 2. The stabilization cone or other structure 62 is preferably, but not limited to be, positioned in the air flow passageway 22 of the burner wall 16 such that at least 75% (more preferably at least 90%) of the diameter or width 80 of the stabilization cone or other structure 62 is located in the lateral half 82 of the air flow passageway 22 adjacent to the lateral interior side 64 of the burner wall 16 and not more than 25% (more preferably not more than 10%) of the diameter or width 80 of the stabilization cone or other structure 62 is located in the opposite lateral half 84 of the air flow passageway 22 adjacent to the opposite lateral interior side 66 of the burner wall 16. More preferably, the entire stabilization cone or other structure 62 is located in the lateral half 82 of the air flow passageway 22 adjacent to the lateral interior side 64 of the burner wall 16.

In addition, the stabilization cone 62 has a forward edge 86 which preferably either contacts or is proximate to the lateral interior side 64 of the burner wall 16. The forward edge 86 of the stabilization cone is preferably within at least 50 mm (more preferably within at least 25 mm) of the lateral interior side 64 of the burner wall 16.

Also, it will be understood that further reduction in $NO_x$ emissions can be achieved in the inventive burner and method by optionally including the use of (a) external flue gas recirculation, (b) steam and/or inert injection into the combustion air stream, (c) steam and/or inert injection into the combustion fuel stream, (d) flameless combustion, and/or (e) an additional staged air region outside the burner wall.

As yet another option, it will be understood that additional reduction in $NO_x$ emissions can be achieved in the inventive burner by also including the use of staged fuel gas tips or a gas annulus located on the exterior of the burner wall 16.

Thus, the present invention is well adapted to carry out the objectives and attain the ends and advantages mentioned above as well as those inherent therein. While presently preferred embodiments and steps have been described for purposes of this disclosure, the invention is not limited in its application to the details of the preferred embodiments and steps. Numerous changes and modifications will be apparent to those of ordinary skill in the art. Such changes and modifications are encompassed within this invention as defined by the claims. In addition, unless expressly stated, the phraseology and terminology employed herein is for the purpose of description and not of limitation.

What is claimed is:

1. A burner apparatus comprising:

a burner wall having a forward end, wherein said burner wall surrounds an air flow passageway which extends through said burner wall, said air flow passageway has a forward discharge opening at said forward end of said burner wall, and said burner wall has a longitudinal axis which extends through said air flow passageway and said burner apparatus having within said air flow passageway surrounded by said burner wall only one combustion fuel discharge tip assembly, said combustion fuel discharge tip assembly within said air flow passageway comprising a single combustion fuel discharge tip having a forward end and a flame stabilizing structure located at, forwardly of, or rearwardly of said forward end of said combustion fuel discharge tip, wherein said combustion fuel discharge tip is located laterally outward with respect to said longitudinal axis of said burner wall at a position which is between said longitudinal axis and said burner wall.

2. The burner apparatus of claim 1 wherein said forward end of said combustion fuel discharge tip is located within a range of from not more than 50 mm reawardly to not more than 50 mm forwardly of said forward discharge opening of said air flow passageway.

3. The burner apparatus of claim 1 wherein said flame stabilizing structure contacts or is within 50 mm of said burner wall.

4. The burner apparatus of claim 1 wherein said combustion fuel discharge tip is a gas fuel discharge tip.

5. The burner apparatus of claim 1 wherein said combustion fuel discharge tip is a round flame discharge tip.

6. The burner apparatus of claim 1 wherein said flame stabilizing structure is a stabilization cone.

7. The burner apparatus of claim 6 wherein at least 75% of a diameter of said stabilization cone is located in a first lateral half of said air flow passageway between said longitudinal axis of said burner wall and a first interior side of said burner wall and not more than 25% of said diameter of said stabilization cone is located in a second lateral half of said air flow passageway between said longitudinal axis of said burner wall and a second interior side of said burner wall opposite said first interior side of said burner wall.

8. The burner apparatus of claim 7 wherein said stabilization cone has a forward edge which contacts or is within 50 mm of said first interior side of said burner wall.

9. The burner apparatus of claim 1 wherein said combustion fuel discharge tip assembly further comprises a fuel riser which extends longitudinally through said air flow passageway to said combustion fuel discharge tip.

10. The burner apparatus of claim 1 wherein said burner wall is a refractory tile wall structure.

11. A burner apparatus comprising:

a burner wall having a forward end, wherein said burner wall surrounds a flow passageway which extends through said burner wall for flow of an oxygen-containing gas, said flow passageway has a forward discharge opening at said forward end of said burner wall, and said burner wall has a longitudinal axis which extends through said flow passageway;

said burner apparatus having within said flow passageway surrounded by said burner wall only one combustion fuel discharge tip, said combustion fuel discharge tip being located in said flow passageway at a laterally outward position with respect to said longitudinal axis of said burner wall which is between said longitudinal axis of said burner wall and a first interior side of said burner wall;

a lean combustion zone projecting forwardly from said forward discharge opening of said flow passageway wherein combustion occurs in an excess oxygen to fuel ratio, said lean combustion zone being located adjacent to a second interior side of said burner wall opposite said first interior side of said burner wall; and a fuel rich combustion zone projecting forwardly from said forward discharge opening of said flow passageway wherein combustion occurs in an excess fuel to oxygen ratio, said fuel rich combustion zone being located adjacent to said first interior side of said burner wall.

12. The burner apparatus of claim 11 wherein said combustion fuel discharge tip has a forward end which is located within a range of from 50 mm rearwardly to 50 mm forwardly of said forward discharge opening of said flow passageway.

13. The burner apparatus of claim 11 further comprising a flue gas recirculation region projecting forwardly from said forward discharge opening of said flow passageway wherein combustion occurs with recirculated inert products of combustion being present, said flue gas recirculation region being located adjacent to said first interior side of said burner wall.

14. The burner apparatus of claim 11 wherein said combustion fuel discharge tip is a gas fuel discharge tip.

15. The burner apparatus of claim 11 wherein said combustion fuel discharge tip is a round flame discharge tip.

16. The burner apparatus of claim 11 further comprising a flame stabilizing structure located within a range of from 50 mm rearwardly to 50 mm forwardly of said forward end of said combustion fuel discharge tip.

17. The burner apparatus of claim 16 wherein said flame stabilizing structure is a stabilization cone.

18. The burner apparatus of claim 17 wherein at least 75% of a diameter of said stabilization cone is located in a first lateral half of said flow passageway between said longitudinal axis of said burner wall and said first interior side of said burner wall and not more than 25% of said diameter of said stabilization cone is located in a second lateral half of said flow passageway between said longitudinal axis and said second interior side of said burner wall.

19. The burner apparatus of claim 17 wherein said stabilization cone has a forward edge which contacts or is within 50 mm of said first interior side of said burner wall.

20. The burner apparatus of claim 11 wherein said burner wall is a refractory tile wall structure.

* * * * *